US005584203A

United States Patent [19]

Eversberg et al.

[11] Patent Number: 5,584,203

[45] Date of Patent: Dec. 17, 1996

[54] ROLLING MANDREL CHANGING DEVICE FOR A PLUG MILL

[75] Inventors: Hans Eversberg, Mönchengladbach; Burkhard Schifferings, Duisburg; Karl-Heinz Häusler, Korschenbroich, all of Germany

[73] Assignee: Mannesmann Aktiengesellschaft, Dusseldorf, Germany

[21] Appl. No.: 515,680

[22] Filed: Aug. 18, 1995

[30] Foreign Application Priority Data

Aug. 18, 1994 [DE] Germany ..... 44 30 576.1
Jul. 21, 1995 [DE] Germany ..... 195 27 771.6

[51] Int. Cl.[6] ..... B21B 25/06

[52] U.S. Cl. ..... 72/209; 72/236

[58] Field of Search ..... 72/201, 208, 209, 72/250, 251, 236

[56] References Cited

U.S. PATENT DOCUMENTS 3,955,392 5/1976 Prevot ..... 72/209

FOREIGN PATENT DOCUMENTS 0335079 10/1989 European Pat. Off. .
2701824 7/1977 Germany .
2759919 11/1977 Germany .
4213276 10/1993 Germany .

*Primary Examiner*—Lowell A. Larson
*Assistant Examiner*—Thomas C. Schoeffler
*Attorney, Agent, or Firm*—Cohen, Pontani, Lieberman, Pavane

[57] ABSTRACT

A device for changing the rolling mandrels of a plug mill. The device including the following arrangement of stations in series. An entry station for feeding the rolling mandrels into the feeding channel of the plug mill, a run-out station for the used rolling mandrels after rolling, and a transfer device for guiding the mandrels into a cooling station. The cooling station undertakes controlled cooling of the rolling mandrels, preferably by a water/air mixture. At the same time, devices remove the scale by joint application of water and mechanical aids. Finally, a drying station dries the cooling water from the surface of the rolling mandrels.

13 Claims, 5 Drawing Sheets

ROLLING MANDREL CHANGING DEVICE FOR A PLUG MILL

BACKGROUND OF THE INVENTION

1. Field of the Invention

The invention relates to a device for changing the rolling mandrels of a plug mill.

2. Description of the Prior Art

When rolling seamless steel tubes in cross-rolling and longitudinally-rolling mills, internal tools of various types are commonly use. Such tools are, for example, piercing mandrels in piercing cross-rolling mills, smoothing stoppers in smoothing cross-rolling mills and stoppers in plug or Stiefel rolling mills. It is common to all mills that the tools are large and heavy in the case of larger tube diameters and an exchange by hand —for example after each pass in the case of the plug-rolling method —means heavy physical work, as a result of which mechanically operating changing devices are used. Such a device for plug-rolling stands is described, for example, in DE-C 27 59 919. Here, a set of two or more stoppers are inserted into a change gear which has a series of pockets. For each new pass, the gear is rotated further by one pocket division, and a new plug is thereby brought into the working position. The used plug slides via a channel into the lower part of the change gear, which lies under water.

This type of change is no longer adequate for present day requirements placed on the rolling method with reference to surface quality and dimensional stability of the tubes. The point is that a change gear of the design described does not allow additional treatment steps at the stopper. Thus, for example, DE-OS 27 01 824 describes a plug-rolling method having a cylindrical rolling mandrel which can be displaced during rolling. Instead of the customary short stopper, a rolling mandrel of greater length is used here, the length being prescribed by the length of travel. As far as is known, this method is not used in practice.

DE-OS 42 13 276 describes a plug-rolling method for rolling tubes of equal wall thickness. With this method it is possible to dispense with the otherwise necessary smoothing rolling mills. In this case, specific, varying setting of the rollers in the successive passes results in a particularly uniform wall thickness. Modern methods for local measurement of hot wall thicknesses, installed directly downstream of the rolling stand, permit an instantaneous inference on the wall thickness distribution in the circumferential direction of the tube just rolled. In order to utilize this advantage, flexible adjustment of the rollers is a great advantage.

As a result of newly developed lubricants, the method according to DE-OS 27 01 824 is becoming topical again. Specifically, a cylindrical rolling mandrel, which can be displaced during rolling, does not develop its full effect until it is itself well lubricated and —as described in EP-A1 03 35 079 —the tube blank is internally lubricated and deoxidized. It is also advantageous to lubricate the hollow block internally and deoxidize it before the first stopper pass. This prevents the damaging influence of the scale, which can collect on the stoppers or rolling mandrels and lead to longitudinal grooves in the tube.

According to current points of view, it is, furthermore, undesirable for conventional stoppers or for rolling mandrels if they fall into a water bath immediately after the rolling. Since, by contrast with the core material, the surface is heated substantially more strongly, strong stresses are formed in the material and lead, in the case of abrupt cooling, to thermal shock cracks on the surface. On the other hand, however, it is necessary to use water in order to split off any scale adhering to the surface.

The fact also has to be considered that during plug rolling generally only one stopper set is used for the work, that is to say two stoppers in the case of two-pass operation. This guarantees that the tube wall thickness is not influenced by differing stopper diameters, such as can arise from differing wear, when more than one stopper set is used. It is possible to depart from this rule when devices are available for measuring the hot local wall thickness downstream of the plug-rolling stand and there is a possibility for individual setting of the rollers after each pass.

When rolling using displaceable rolling mandrels and only one set of rolling mandrels, a problem which arises is the relatively short cycle time which is available for a circulation of the rolling mandrels. In the medium tube diameter range, plug mills roll as many as 120 tubes per hour at a cycle time of 30 s. In this time, the rolling mandrel must pass through the entire manipulation chain from ejection up to reinsertion. In practice, this excludes a circulation using only one rolling mandrel set. For this reason alone, it is sensible to work using more than only one set of rolling mandrels, for example two or more sets, when the boundary conditions, that is to say local measurement of the wall thickness downstream of the plug-rolling stand, or diameter sorting of the rolling mandrels are observed. If, however, a relatively large number of rolling mandrels pass successively through the changing device, the treatment times such as, for example, cooling, remain equally short, since each rolling mandrel must be passed on by one step in the cycle of the plug mill. It is therefore advantageous not to permit all the rolling mandrel sets to pass through the same stations successively, but in the case, for example, of two or more sets to send a proportion of the rolling mandrels into a second, parallel circulation after ejection from the rolling stand. This lengthens the cycle time by the factor of the respective number of the individual machining stations. This would have the additional advantage that it is possible to operate optionally using one or two rolling mandrel series if circumstances require. In this case, a rolling mandrel series is the number of the rolling mandrels which are in circulation in order to cover all the machining stations: one series consists of a plurality of —but at least two —rolling mandrel sets.

The following requirements therefore exist for a modern plug mill:

- It must be possible to use displaceable stoppers, that is to say rolling mandrels.
- Manual changing of the rolling mandrels is to be excluded.
- The rolling mandrels are to be covered before each pass with a viscous lubricant.
- The temperature of the rolling mandrels must be in a range which guarantees rapid drying of the lubricant without the formation of steam bubbles.
- The cooling of the rolling mandrels after rolling must proceed so gently that thermal shock cracks are reduced.
- The scale-splitting effect of the water must be retained.
- It must also be possible to work using a single rolling mandrel series; if the cycle time requires, using two or more rolling mandrel series.

SUMMARY OF THE INVENTION

Accordingly, it is an object of the present invention to provide a device for changing rolling mandrels which satisfies the above-mentioned requirements.

Pursuant to this object, and others which will become apparent hereafter, the inventive rolling mandrel changing device consists of the following stations in series:

1. A waiting position for the rolling mandrel upstream of the feeding channel to the plug-rolling stand.
2. An entry station for the rolling mandrels in the feeding channel of the plug-rolling stand.
3. A collecting station for the used rolling mandrels downstream of the rolling, and a transfer device into the cooling device.
4. A cooling station for controlled cooling of the rolling mandrels, preferably by means of a water/air mixture, as well as, at the same point, devices for removing the scale by joint application of water and mechanical aids.
5. A station for drying the cooling water from the surface of the rolling mandrels.
6. An intermediate station for monitoring the dimensions and surfaces of the rolling mandrels.
7. A station for wetting the surface of the mandrels with a liquid lubricant which is dried by the intrinsic heat of the mandrel or by additional means such as hot air or infrared radiation.
8. A depositing facility for used rolling mandrels.

9A storage device for new rolling mandrels with the possibility of preheating. The device can be designed for a single series of two or more rolling mandrel sets, or for the use of two rolling mandrel series, but operated with only one series.

It is possible to connect a heating device upstream of the rolling mandrel changing device, in which heating device the rolling mandrels are heated, when first used, up to the required lubricating temperature.

According to another embodiment of the invention changing device is designed for a series of rolling mandrels, or is designed for two or more rolling mandrel series.

In yet another embodiment of the invention the cooling station includes means for spraying a water/air mixture into a cooling chamber. The spraying of the water/air mixture being adjusted so that an air surplus is set initially and is changed successively during the course of cooling into a water surplus.

In another embodiment of the invention the cooling station includes means for spraying cooling water having a soluble or finely divided lubricant mixed therein.

In another embodiment of the present invention, a lubricant suspension is applied in the lubricating station to the rolling mandrel surface after cooling of the rolling mandrel in the cooling station and drying of the mandrel in the drying station. The applied lubricant is dried before the rolling mandrel is reused.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
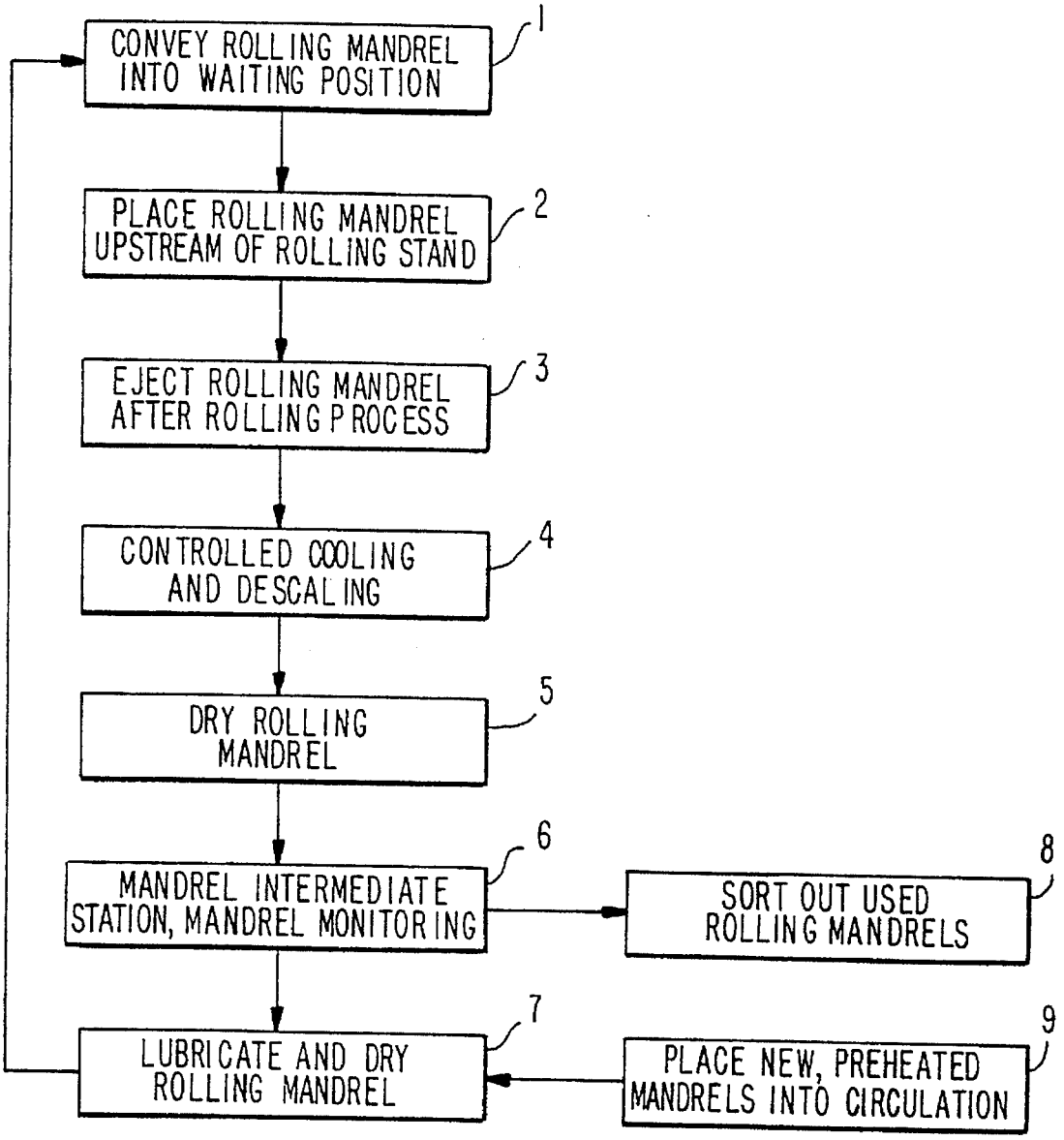
FIG. 1 is a flow chart indicating operation of the presently claimed invention or a cycle with one rolling mandrel series.

The working cycle of the rolling mandrel changing device according to the invention is represented in two flow diagrams. Specifically FIG. 1 is for the circulation using a single rolling mandrel series while FIG. 2 uses two rolling mandrel series. The numbers in brackets correspond to the numbered stations in FIGS. 4 and 5. The cycle and the mode of operation of the device according to the invention are described below. In addition, the functions are explained with reference to FIGS. 3 to 5.

Figure 3:
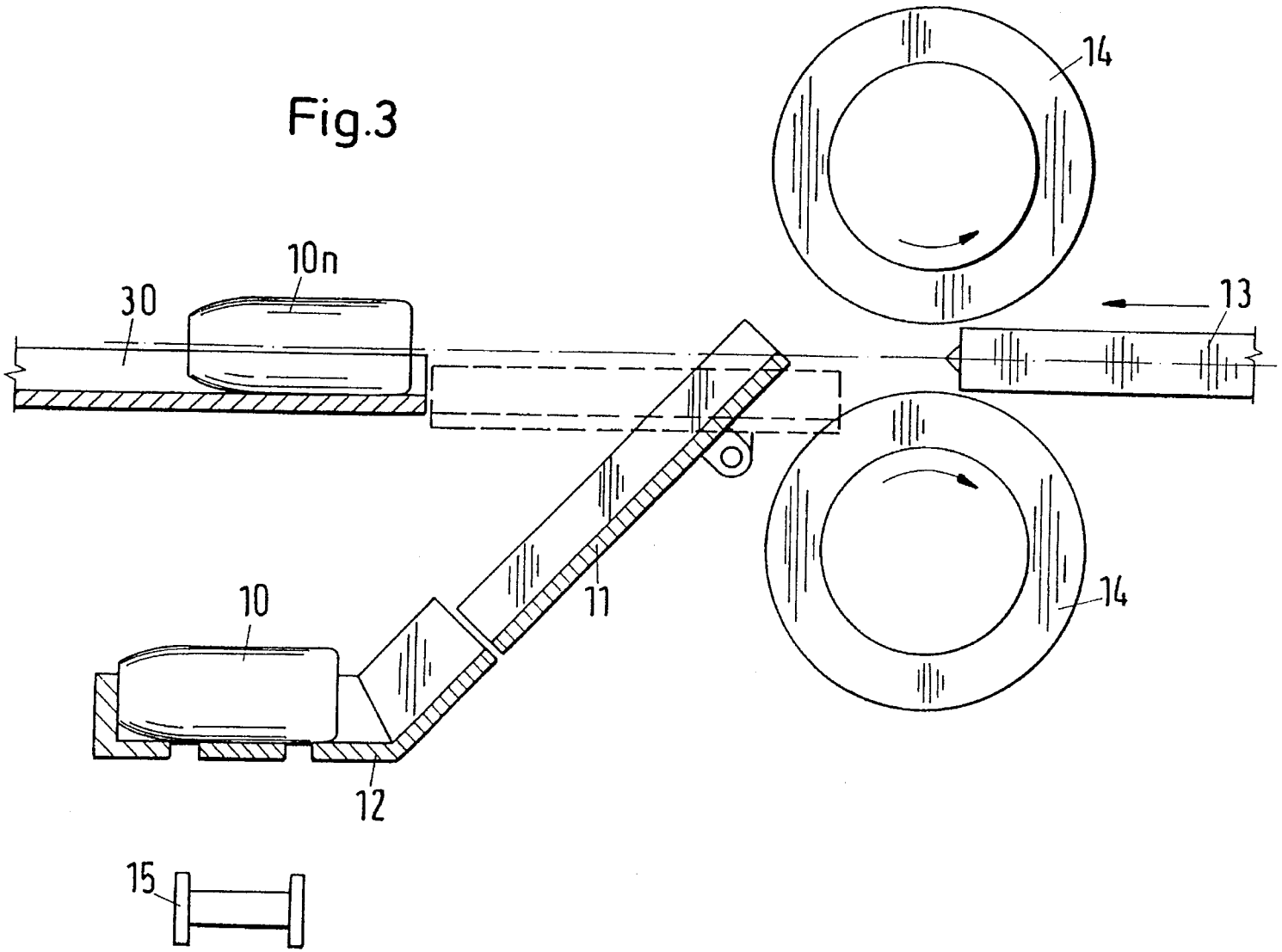
FIG. 3 is an end view of the present invention showing entry and removal of a rolling mandrel.

The following description relates to the functional cycle according to FIG. 1, when operating using only one rolling mandrel series. The number of the rolling mandrels which form a series corresponds in this case to the number of the main stations represented, specifically six. Of these, three are roughing rolling mandrels and three are finishing rolling mandrels in the case of operation using two different rolling mandrel diameters. These mandrels successively pass through the following stations, that is to say a roughing rolling mandrel is always followed by a finishing rolling mandrel. The machining time in each of the individual stations corresponds in this case to half the cycle time of the plug mill, since after all each tube is rolled by the use of two rolling mandrels. If, by contrast, three rolling mandrels are used in the operation, that is to say two roughing rolling mandrels and one finishing rolling mandrel, the cycle time for each rolling mandrel is divided by three. In both cases, the cycle is as follows:

As seen in FIG. 3, after rolling the used rolling mandrel 10 slides, in a manner known to the person skilled in the art, out of the roll gap and into a collecting station 12 via a downwardly inclined and horizontally pivotable track 11.

The rolling mandrel 10 is supported during rolling on a support rod 13 which can be displaced in its longitudinal direction. The support rod 13 is shown in its end position, which it assumes directly after the end of the rolling process. The two rollers 14 of the plug-rolling stand (not shown) are still open, in order to permit the passage of the rolled tube, which is withdrawn opposite to the rolling direction and is likewise not represented. A new rolling mandrel **10*n* is already in a waiting position in the feeding channel 30 of the entry station 2** for the new rolling process.

Figure 4:
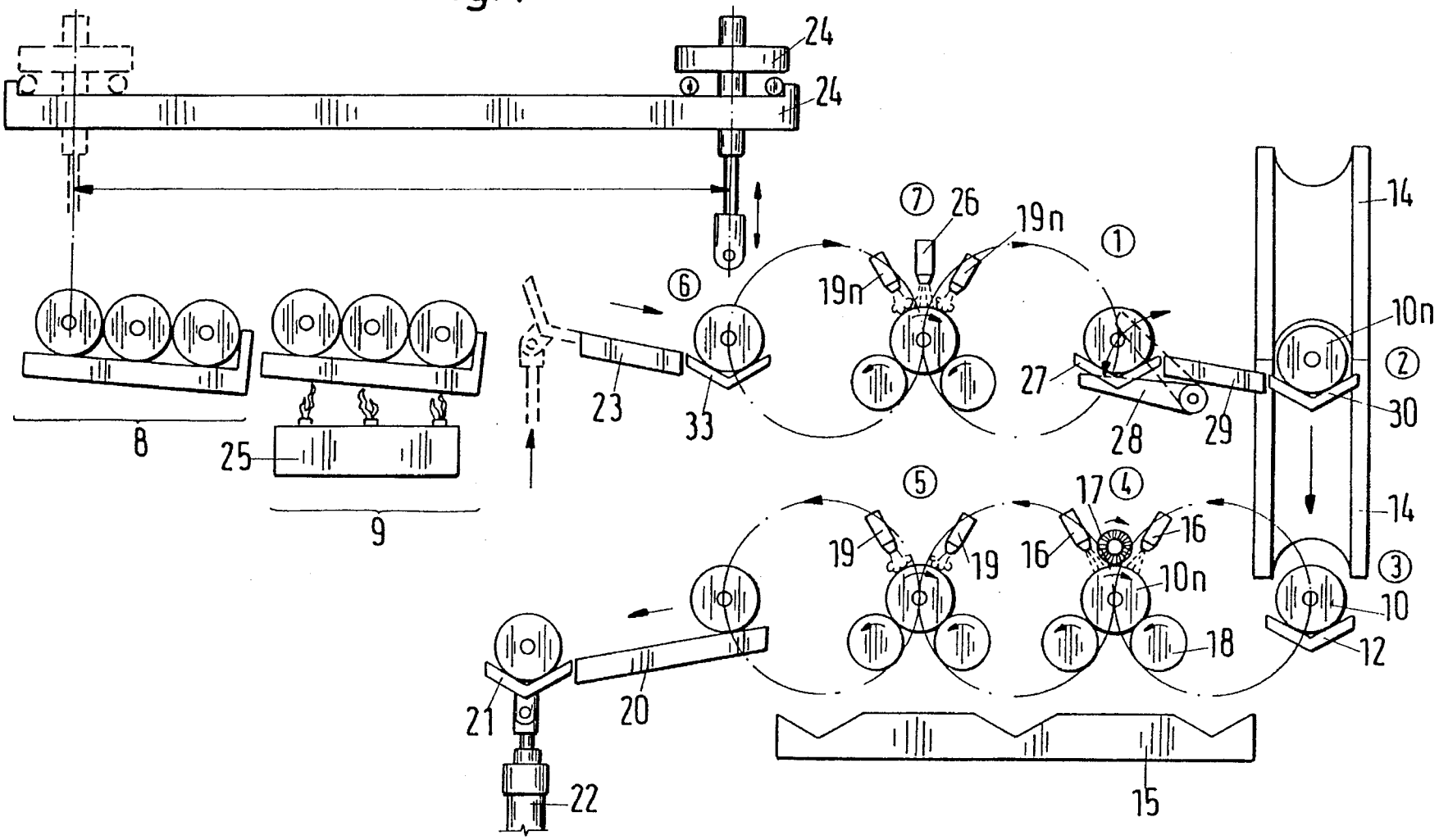
FIG. 4 is a schematic representation of the invention.

The rolling mandrel 10 is inserted from the collecting station 12 according to FIG. 4 into the cooling and descaling station 4 by means of a transport element 15. The transport element 15 is represented in FIG. 4 as a so-called walking-beam transport which by means of its vertical circular movement lifts the rolling mandrels over from one station into another. The cooling and descaling station 4 consists of a compartment in which after insertion of the rolling mandrel **10*n*, for example, a mixture of air and water is sprayed in by means of the spray nozzles 16 until the rolling mandrel 10*n* has reached the required low temperature. The air/water mixture exerts a smaller quenching effect on the rolling mandrel surface at the start of cooling, for example, an air surplus is used in the operation and passes over successively into a water surplus. In this station, a portion of the scale is split off by the action of the water. Larger amounts of baked-on scale are removed mechanically when the rolling mandrel 10***n* is rotated with the aid of the rotating device 18, and the surface of the rolling mandrels is cleaned, for example, by means of a rotating brush 17, scraping, grinding or scratching.

The transport element 15 now passes on the rolling mandrel 10*n* to the drying station 5, where it is dried due to its own heat or, if necessary, additionally by the illustrated hot-air nozzles 19, infrared radiators or the like. Subsequently, the rolling mandrel 10*n* is deposited by the transport element 15 onto a run-off bevel 20, and rolls into a collecting channel 21. This collecting channel 21 is raised by a raising device 22 into an upper plane and tilted, and the rolling mandrel 10*n* is emptied via a second runoff bevel 23 into a collecting channel 33 of the intermediate station 6.

At this point, the rolling mandrel 10*n* is monitored for its further usability, and is either left in circulation or else is acquired by a further transport device 24 and passed to the depositing facility 8. Subsequently, it is necessary for a new rolling mandrel 10*n* to be removed by the transport device 24 from the stock pile 9 and installed in the gap produced by removal of the old mandrel. The rolling mandrels can be heated in the stock pile 9 by a heating device 25 up to a temperature which permits the water-containing lubricant applied to the rolling mandrel 10*n* to dry.

Lubrication and possible additional drying are undertaken in the lubricating station 7. For this purpose, the rolling mandrel 10*n* is transported into the lubricating station 7 by a transport element of the same type as discussed previously in connection with the drying station 5 and the cooling and descaling station 4. In this case, spray nozzles 26 apply the lubricant suspension. After a short waiting time, the lubricant suspension dries and adheres to the rolling mandrel surface as a film. Drying can be supported, in addition, by a number of hot-air nozzles 19*n*.

The lubricated and dried rolling mandrel 10*n* is now fed into the collecting channel 27 of the waiting station 1. Starting from here, it is transferred by an ejector 28 via a run-off bevel 29 into the feed-in channel 30, which is also shown in the side view in FIG. 3.

Figure 2:
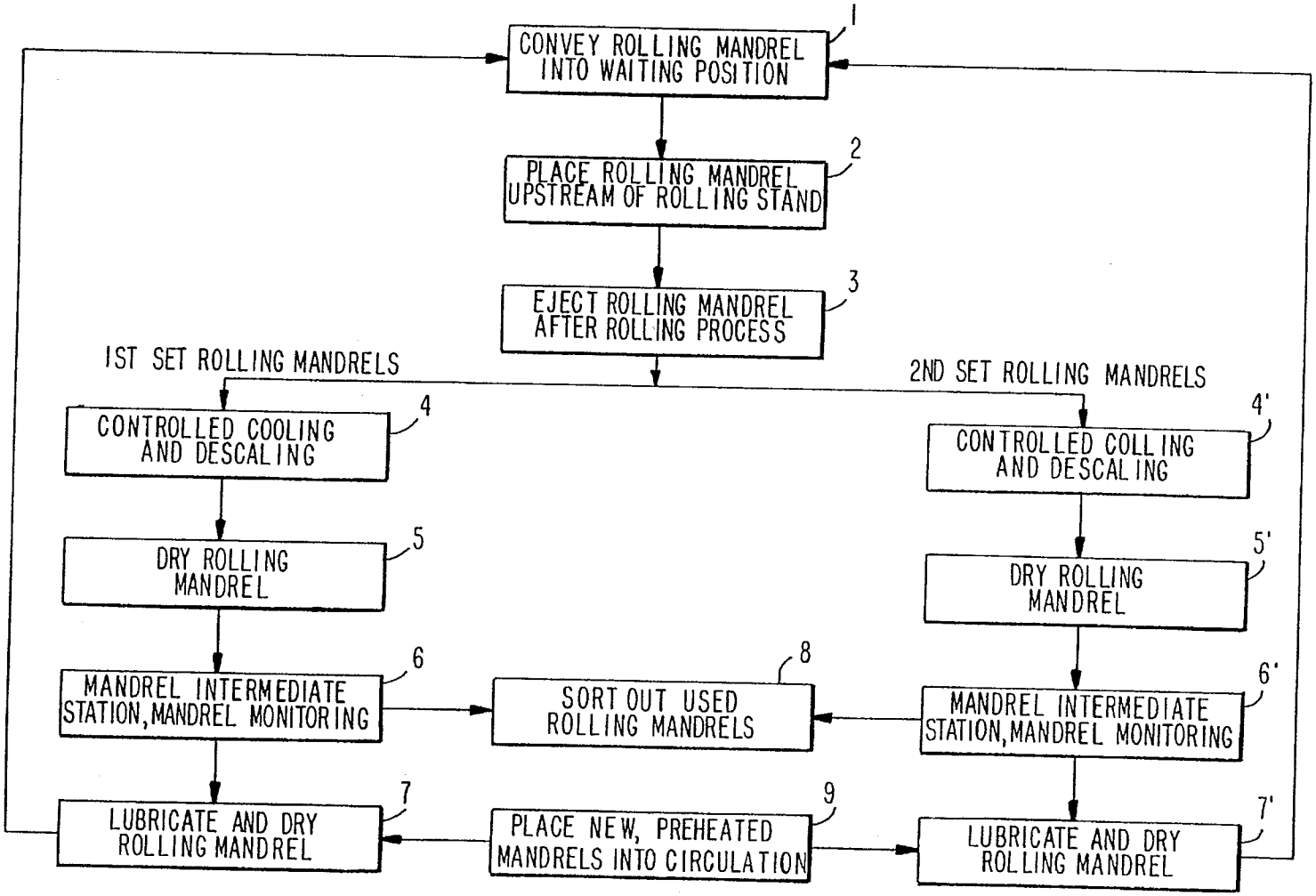
FIG. 2 shows a flow chart for a cycle of two rolling mandrel series.
Figure 5:
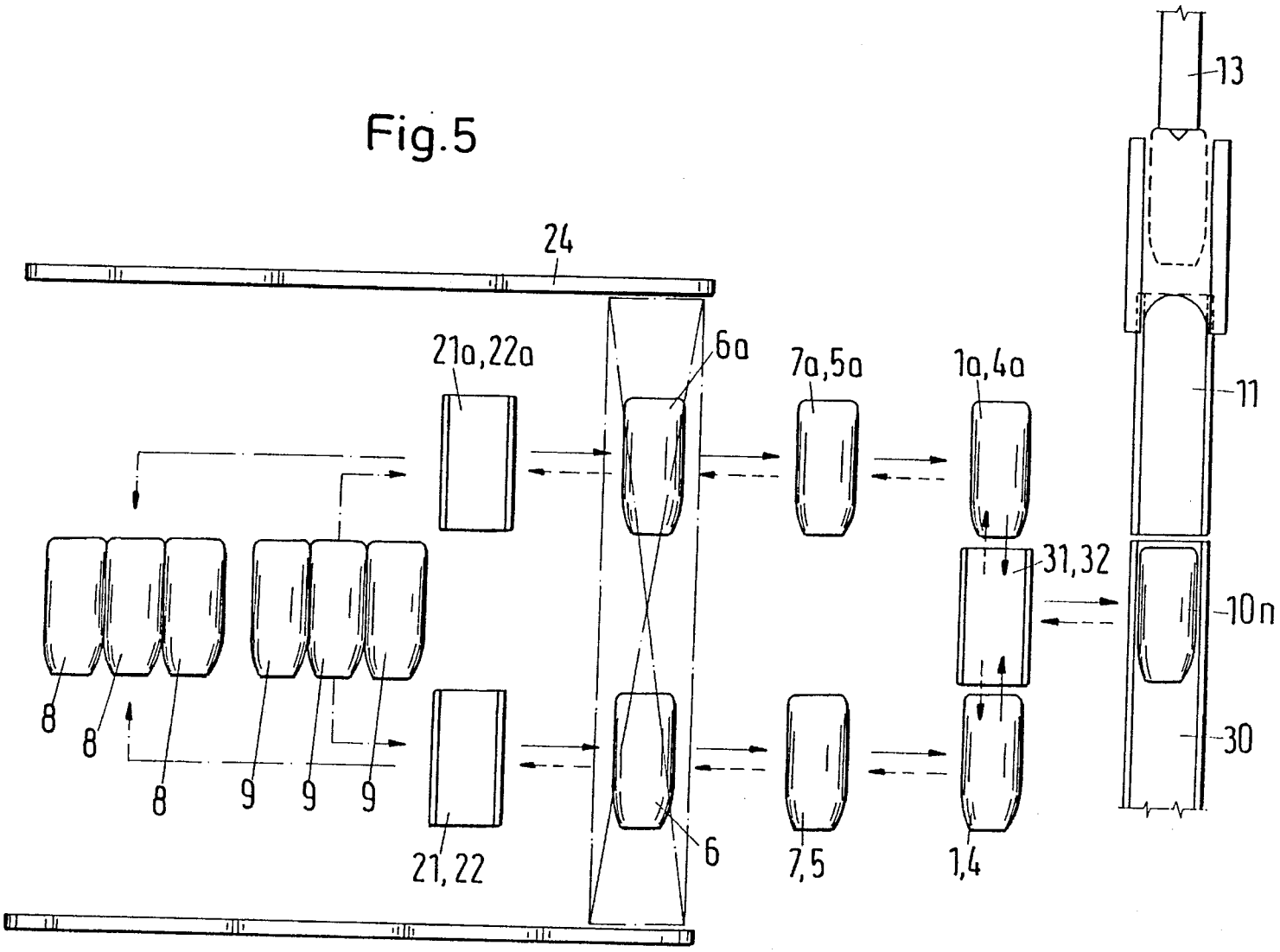
FIG. 5 is a plan view of FIG. 4.

A mode of procedure according to FIG. 2 is possible for the purpose of lengthening the machining time for the individual rolling mandrel. Here, two series of rolling mandrels are in circulation, with the advantage that the entire cycle time of the plug mill is available in each station for machining the individual rolling mandrel. This is achieved by doubling the number of machining stations. The stations 1, 4, 5, 6 and 7 are therefore present twice with the addition of letter "a ". FIG. 5 shows a plan view of FIG. 4. This FIG. 5 represents the diagrammatic arrangement of the individual stations. Starting from the collecting station 3, present only once, with the collecting channel 12, the rolling mandrel 10*n* is fed to the cooling and descaling station 4, or to the second cooling and descaling station 4*a*, arranged parallel thereto at the same level.

The arrows between these two stations indicate that the rolling mandrel 10*n* can be transported out of the lower distributing channel 31 either to the right or to the left to the stations 4 or 4*a*. The dashed arrow indicates the transport direction of the lower plane, and the continuous arrow that of the upper plane. The type of transport may be left open here. For example, the transport can be in the form of rams which push the rolling mandrel 10*n* out of the lower distributing channel 31, either to the left or to the right. From here, the rolling mandrel 10*n* passes through the individual stations in a way already described. Since the depositing facility 8 and the stock pile 9 are present only once, the transport device 24 has the task here of distributing the rolling mandrels between the individual stations 6, 6*a*, 8 and 9 in the appropriate sense, that is to say either from 6 and 6*a* to 8, or from 9 to 6 or 6*a*.

From the two waiting positions 1 and 1*a*, the rolling mandrels are combined in an upper distributing channel 32 —which is located in a plane above the lower distributing channel 31 —and inserted starting from here into the feeding channel of the entry station 2.

When two rolling mandrel sets are used, it is possible to select whether only the roughing mandrels are sent into one circuit and the finishing mandrels are sent into the other circuit, or whether the roughing and finishing mandrels remain one behind another, as they come out of the rolling mill.

FIG. 5 represents one of the plurality of arrangements in principle, in which the individual machining stations can be arranged. In another variant (not represented), it is possible, for example, to arrange the two circulations to the right and left of the inlet of the plug mill. In this case, it would also be necessary to include the stations 8 and 9 twice in the plan. In another variant, the individual stations can be arranged not one above another, but next to one another in a common plane. In this way, the formerly bottom stations are more easily accessible, but require a larger extent of area.

The avenues described so far for machining the rolling mandrels are firmly linked to the plug mill when seen from the point of view of the method cycle and the timing. Consequently, the treatment time in the individual machining stations must follow the timing of the plug mill. The machining time in the individual stations can at most only be the length of the cycle time of the plug mill. In cases of a high number of rolled tubes per time unit, this is relatively short and can lead to non-optimum results.

It is therefore desirable to separate the functions of plug rolling and preparation of rolling mandrels from one another in time and space. This can be done by collecting the used stoppers in containers after monitoring for good/bad results. These containers are conveyed to a conditioning device for the rolling mandrels, which is set up in a position independently of the location of the plug mill.

Reconditioned and lubricated rolling mandrels are collected in the other containers, transported back to the rolling mill and reused there. By precisely fixed positioning of the rolling mandrels in the containers, the transport can be systematized by providing that the containers can be designed, for example, as a magazine. The rolling mandrels can then be specifically extracted from the magazine by a manipulator and fed to the rolling mill. The magazines form a circuit between the rolling mill and the conditioning device for the rolling mandrels.

It is advantageous in this variant that the treatment of the rolling mandrels can be performed independently of the cycle time of the plug mill. The machining time can thus be lengthened and optimized. If, for example, the conditioning device operates in three shifts and the plug mill works only in two shifts, the third shift is available as an additional machining time. It is also possible to optimize the machining devices such that a plurality of rolling mandrels are simultaneously cooled, descaled, dried and lubricated in one station. The capacity of the conditioning device is substantially increased thereby, and the treatment time of the individual rolling mandrels is lengthened again.

The invention is not limited by the embodiments described above which are presented as examples only but can be modified in various ways within the scope of protection defined by the appended patent claims.

I claim:

1. A device for changing rolling mandrels of a plug mill, comprising, in series:

entry station means for guiding the rolling mandrels into a feeding channel of the plug mill;

cooling station means for cooling the rolling mandrels with a water/air mixture;

run-out station means for guiding the rolling mandrels, after rolling in the plug mill, into the cooling station means;

means for removing scale from the mandrels by joint application of water and mechanical aids simultaneously with the cooling by the cooling station means;

drying station means for drying cooling water from the surface of the rolling mandrels; and lubricating station means for wetting the surface of the mandrels with a liquid lubricant which is dryable by intrinsic heat of the mandrels.

2. The rolling mandrel changing device as defined in claim 1, and further comprising means for applying heat to the surface of the mandrels to assist in drying of the liquid lubricant.

3. The rolling mandrel changing device as defined in claim 1, wherein the device is configured for a series of rolling mandrels.

4. The rolling mandrel changing device as defined in claim 1, wherein the device is configured for at least two rolling mandrel series.

5. The rolling mandrel changing device as defined in claim 1, wherein the cooling station means includes a cooling chamber and means for controllably spraying the water/air mixture into the cooling chamber so that initially the water/air mixture has an air surplus and successively during cooling the water/air mixture is changed to have a water surplus.

6. The rolling mandrel changing device as defined in claim 1, wherein the water/air mixture includes a lubricant admized therewith.

7. The rolling mandrel changing device as defined in claim 6, wherein the lubricant is one of a soluble and finely divided lubricant.

8. The rolling mandrel changing device as defined in claim 1, wherein the lubricating station means is operative to apply a lubricant suspension to the surface of the rolling mandrels after cooling of the rolling mandrels by the cooling station means and drying of the rolling mandrels by the drying station means.

9. The rolling mandrel changing device as defined in claim 8, wherein the drying station means is operative to dry the lubricant suspension before the rolling mandrels are used in the plug mill.

10. The rolling mandrel changing device as defined in claim 1, and further comprising means for heating the rolling mandrels for a first use in the plug mill, the heating means being arranged upstream of the entry station means.

11. The rolling mandrel changing device as defined in claim 1, and further comprising depositing means for receiving used rolling mandrels.

12. The rolling mandrel changing device as defined in claim 1, wherein the plug mill has a roller, and further wherein the entry station means, the cooling station means, the run-out station means, the drying station means and the lubricating station means are arranged to form two circuits for the rolling mandrels respectively arranged right and left of a middle of the plug mill roller.

13. The rolling mandrel changing device as defined in claim 1, wherein the plug mill includes a roller, and further wherein the entry station means, the cooling station means, the run-out station means, the drying station means, and the lubricating station means are arranged to define two circuits for the rolling mandrels, the two circuits being arranged on one side of a middle of the roller of the plug mill.

* * * * *